United States Patent [19]

Daigle

[11] Patent Number: 4,964,574

[45] Date of Patent: Oct. 23, 1990

[54] CONSTANT PRESSURE NOZZLE SYSTEM

[76] Inventor: Robert V. Daigle, 762 NE. 42nd St., Pompano Beach, Fla. 33064

[21] Appl. No.: 408,048

[22] Filed: Sep. 15, 1989

Related U.S. Application Data

[63] Continuation-in-part of Ser. No. 267,855, Nov. 7, 1988, abandoned.

[51] Int. Cl.[5] ..... A62C 31/02

[52] U.S. Cl. ..... 239/589; 169/37

[58] Field of Search ..... 239/589, 590, 591; 138/37, 39, 44, 177; 169/16-18, 37, 41

[56] References Cited

U.S. PATENT DOCUMENTS

| | | | |
|---|---|---|---|
| 907,025 | 12/1908 | Ford | 239/589 |
| 1,958,085 | 5/1934 | Hammon | 239/589 |
| 2,410,215 | 10/1946 | Houghton | 239/589 |
| 3,405,488 | 10/1968 | Nelson | 52/287 |
| 3,604,510 | 9/1971 | Tainsh | 169/37 |
| 4,785,888 | 11/1988 | Blum et al. | 169/37 |

*Primary Examiner*—Andres Kashnikow
*Assistant Examiner*—Karen B. Merritt
*Attorney, Agent, or Firm*—M. K. Silverman

[57] ABSTRACT

A constant pressure fluid flow acceleration nozzle system includes a nozzle having a bore, such bore having substantially the geometry of a conical section, the section having an input to the bore and an output therefrom, the input to the bore being larger than the output. The bore is provided with uniformly tapered interior walls, the walls defining a uniform inward radial taper of about one unit of length for every nine units of axial length of the bore. The ratio of the cross-section of the diameter of the input to said bore to the cross-sectional diameter of the output to said bore is preferably about 1.6 to one. Resultantly, increased velocity within the bore, without material increase in pressure is achieved to thereby minimize turbulence and achieve a better fluid distribution.

13 Claims, 4 Drawing Sheets

CONSTANT PRESSURE NOZZLE SYSTEM

REFERENCE TO RELATED APPLICATION

This case is a continuation-in-part of Application Ser. No. 07/267,855, filed Nov. 7, 1988, entitled Constant Pressure Nozzle System, now abandoned.

BACKGROUND OF THE INVENTION

The present invention relates to a constant pressure water nozzle typically used in a context of piping systems having utility in connection with fire extinguishing.

Sprinkler nozzles of the type adapted for use in the combatting of fires, have been known for sometime and, more particularly, have existed in the art at least since the year 1915. However, a problem in prior art sprinkler nozzles has been that efforts directed to broadening the area of distribution of the output of such spray systems have generally resulted in increased turbulence within the fluid flow such that the value of any increased velocity resultant from venturi or other fluid dynamic effects in the nozzle has been largely negated. The present invention, apart from its application within a modular water distribution system, exhibits a unique internal geometry which provides constant pressure throughout the longitudinal length of the nozzle, thereby reducing turbulence and increasing the area of spray distribution from the nozzle.

Representative prior art known to the inventor includes U.S. Pat. No. 3,195,647 to Campbell; U.S. Pat. No. 907,025 to Ford; U.S. Pat. No. 3,768,736 to Cox; U.S. Pat. No. 4,300,723 to Prasthoffer; U.S. Pat. No. 4,405,018 to Fischer; and U.S. Pat. No. 4,785,888 to Blum.

None of the above, or other art of which the inventor is aware, discloses the use of constant pressure, increased velocity, sprinkler nozzle or system.

SUMMARY OF THE INVENTION

The instant invention defines a constant pressure fluid flow acceleration nozzle system including a nozzle having a bore, said bore having a substantially conical inner surface, from an input thereof having an area Ai to an output thereof having an area Ao, said output having an axial length xo measured from said input, in which said conical surface of said bore exhibits a convexity relative to said axis of said bore, and in which the radial cross-sectional area (Az) of said bore, at any axial point Xz between said input and said output of the bore is defined by the equation:

$$Az=Ai-Xz(Ai-Ao)/Xo,$$

and any radius at Rz at any point Xz along the axis of the bore as thereby defined by the equation $Rz=(Az/pi)^{\frac{1}{2}}$ in which the taper of said conical surface in accordance with said equations will effect an increase in velocity across the axial distance from the input to output while maintaining a substantially constant pressure through the axial length of the bore, thusly producing a low turbulence, accelerated velocity output of the inventive nozzle system.

Through the use of such a defined taper of the bore of the nozzle, the velocity of fluid passing therethrough may, due to a venturi effect, be increased in velocity without materially increasing the pressure within the bore of the nozzle. Accordingly, turbulence, which is generally caused by abrupt increases in pressure is minimized and, resultingly, a more efficient range of water distribution from the sprinkler head located at the output of the sprinkler nozzle is achieved. In other terms, turbulence is minimized because the above-defined bore geometry operates to gradually reduce cross-sectional fluid mass while other venturi-like sprinkler nozzles (for example, a nozzle of the type shown in the above cited U.S. Pat. No. 3,195,647), decrease the bore cross-section too rapidly, thereby abruptly increasing the velocity and, consequently, increasing the energy of the fluid (which varies in accordance with the square of the velocity) causing turbulence and inefficiency in the distribution capability resulting therefrom.

In a further embodiment, prior art sprinkler nozzles may be retro-fitted with a cone-like insert having the above defined bore geometry.

It is therefore an object of the present invention to provide an improved sprinkler nozzle having benefits of decreased turbulence and improved effective water distribution.

It is another object of the present invention to provide a sprinkler nozzle that will accelerate the velocity of the fluid passing therethrough while maintaining a substantially constant energy level within the fluid flow.

It is a further object of the present invention to provide a sprinkler nozzle of the above type which may be constructed by means of a retro-fit insert into prior art sprinkler nozzles.

It is a still further object of the present invention to provide a sprinkler head which will operate efficiently having an output either at right angles to, or in alignment with, the thrust of the fluid output of the bore of such nozzle.

The above and yet other objects and advantages of the present invention will become apparent in the hereinafter set forth Detailed Description of the Invention, the Drawings, and the Claims appended herewith.

DETAILED DESCRIPTION OF THE INVENTION

Figure 2:
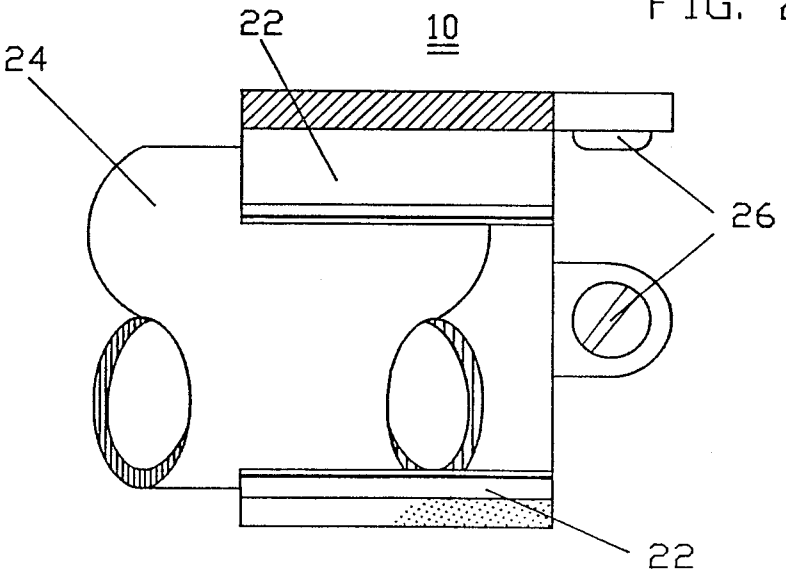
FIG. 2 is a front perspective view of the waterpipe system shown in FIG. 1, with its cover plate removed.
Figure 1:
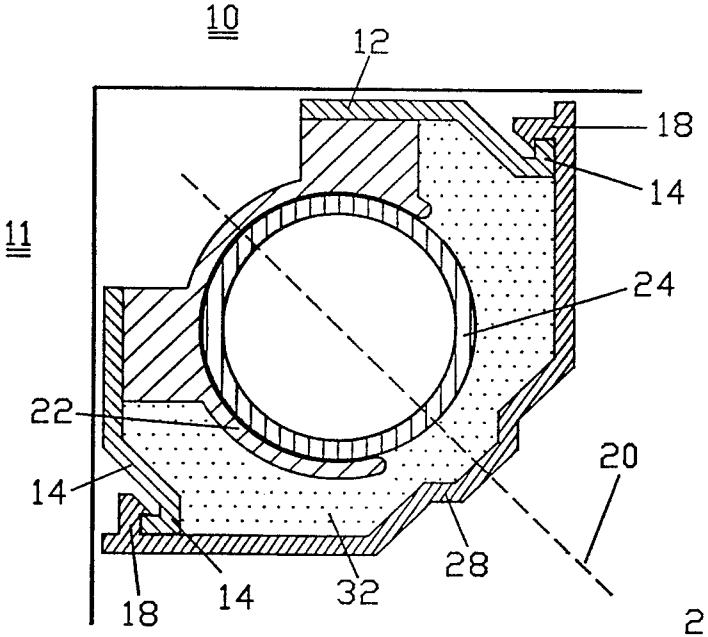
FIG. 1 is a radial cross-sectional view of a modular waterpipe system.

With reference to the views of FIGS. 1 and 2 there is shown an embodiment of the modular pipe system. Therein, there is shown positioned via holding elements 26, at the region of intersection between a ceiling 10 and a wall 11, a back plate 12, the edges of such plate comprising longitudinal first complemental coupling means 14 which, in the embodiment of FIG. 1, take the form of a male snap-fit coupling which mates with second complemental coupling 18 of front plate 28. Back plate 12, as well as further elements described below, are symmetric about the axis of line 20.

As may be further noted, the interior of back plate 12 is provided with integral nesting element 22, the function of which is to receive a pipe 24 in snap-fit relationship therewith. Accordingly, the modular pipe system, in operation, involves, as a first step, the securement of back plate 12, to ceiling 10 and wall 11.

Thereafter, the front plate (also alternately termed a heat shield) 28, having on the edges thereof longitudinal second complemental coupling means 18, is snap-fitted onto first complemental coupling means 14. Accordingly, as may be appreciated in the view of FIG. 1, the second complemental coupling means 18 of the front plate 28 is proportioned for snap-fit engagement with the first complemental coupling means 14 of back plate 12, such that the front plate may be readily attached to the back plate, thereby enclosing the pipe 24 without need for the use of costly bracketing, gluing or the like.

A further advantage of the above described system is that insulation 32 may be placed in the area indicated by the shading in FIG. 1. According, the pipe 24 may be protected by materials such as shredded fiberglass insulating material and, as well, by front plate 28 which, in many applications, will be formed of a high fire-resistant material such as a G.E. mineral-filled NORYL. Accordingly, there is achieved a pipe and pipe support system which is stable, and which may be readily serviced by the simple snap-removal of front plate 28 from back plate 12 and, if necessary, the snap-removal of pipe 24 from nesting elements 22 of back plate 12.

The above described system is particularly useful where the installation of fire sprinklers or nozzles is contemplated in that such nozzles or sprinklers may be easily installed within a pipe system that may be readily assembled and disassembled in accordance with the principles of the embodiment described above.

Figure 3:
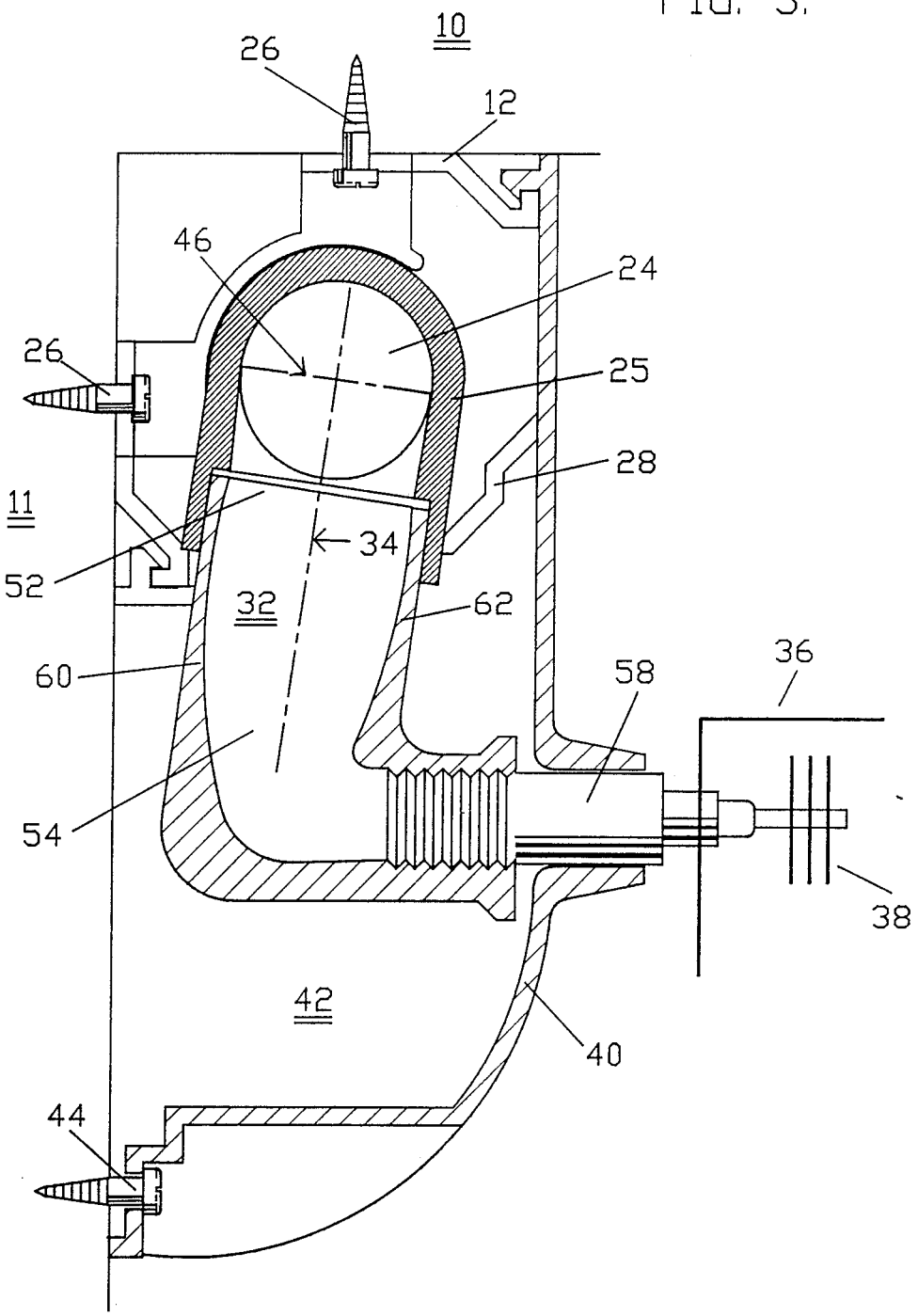
FIG. 3 is a radial cross-sectional view of a sprinkler nozzle, in accordance with the present invention, integrated into a waterpipe system of the type shown in FIG. 1.
Figure 4:
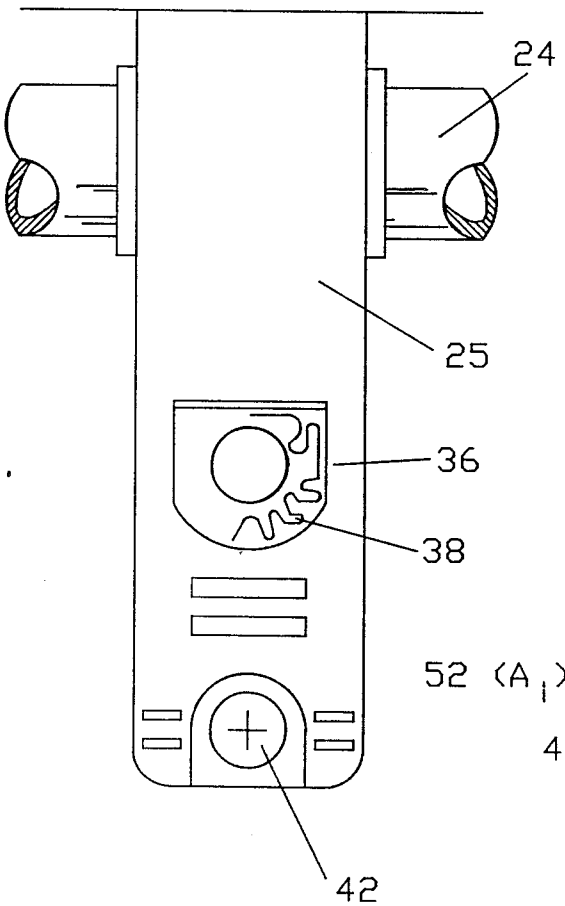
FIG. 4 is a front view of the sprinkler nozzle shown in FIG. 3, with its cover plate removed.

With reference to the views of FIGS. 3 and 4 there is shown, in radial cross-sectional view, a water sprinkler and nozzle system constructed in accordance with the present invention and particularly adapted for integration into pipe 24 of the above described waterpipe system. The modular nozzle system is seen to include a T-intersection sprinkler housing 25 which is rotationally mounted about pipe 24. Such a slidable rotational relationship between the sprinkler system and pipe 24 permits adjustability of the nozzle system and the axis of its fluid thrust with reference to the floor and walls of the room within which it is placed.

The nozzle assembly is seen to further include a sprinkler head 36 including a deflector plate 38.

The sprinkler assembly is further provided with a cosmetic and heat shielding cover 40 and a smoke detector 42. As may be noted, the shielding cover 40 and its integrally attached elements are secured to wall 11 at point 44.

Figure 5:
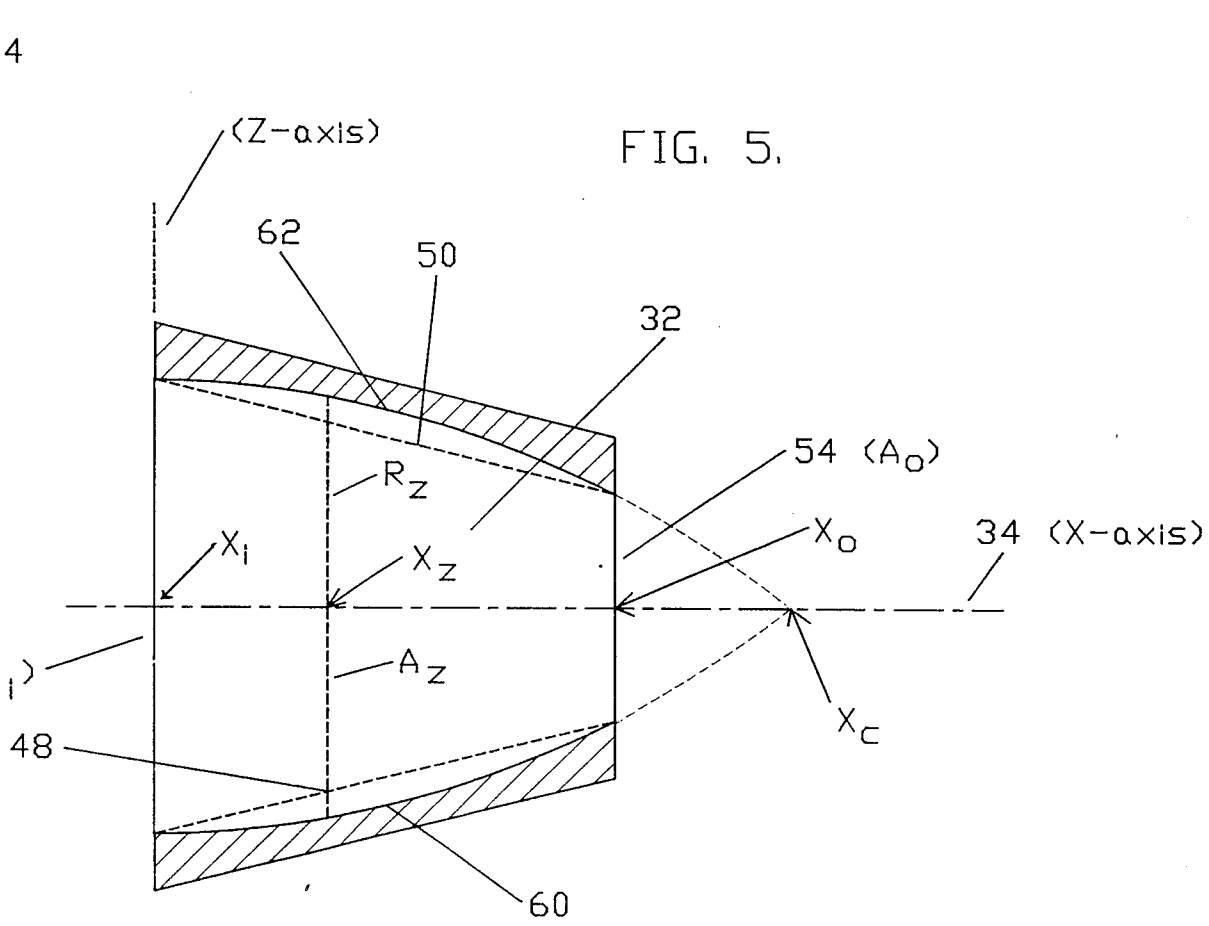
FIG. 5 is a schematic, cross-sectional view of the interior of the bore of the inventive nozzle, with the convex curvature thereof exaggerated.

With reference to the views of FIGS. 3 and 5, the internal and novel geometry of bore 32 of the nozzle system may be seen. Said bore, more particularly, includes an input-to-output axis 34 (the x-axis) having a length Xo and an input diametric cross-sectional axis 46 (the z-axis) corresponding to an area Ai of an input 52 of bore 32. The area of output 54 of the bore is designated Ao.

The taper of the bore is defined by lower interior wall 60 and upper interior wall 62 of said bore 32. In the embodiment of FIG. 3, said taper is that of a gradual uniform linear taper. This taper has been developed as a result of reiterative, empircal studies to develop a venturi-like sprinkler nozzle having the parameters of substantially constant pressure throughout its x axis fluid flow and having a substantially constant energy of the fluid at any given x axis point Xz within the bore 32, to thereby create a low turbulence sprinkler nozzle which is necessary to achieve an enhanced spray distribution of the nozzle system. These characteristics have been substantially achieved in the instant invention through the use of a more gradual taper than has been used in prior art venturi nozzles. Through the use of such a gradual taper, the velocity of fluid flow (along the x axis) can be increased without increasing internal pressure, back pressure or internal fluid energy. Therein, the taper of bore 32 is sufficiently gradual to prevent a venturi effect from completely dominating the fluid dynamics of the nozzle system.

With further reference to the view of FIG. 5, it has been found that the ratio of the area of output 54 to the area of input 52 is equal to the difference between the length of the point of convergence Xc of curves 60 and 62) and the length Xo (the distance between the intersection of the plane of the output and the plane of the input of nozzle 32), this divided by length Xc, or stated mathematically:

$$Ao/Ai=(Xc-Xo)/Xc$$

From the above relationships it can be determined that $$Xc=(Ai\ Xo)/(Ai-Ao)$$

From the above relationships, it can be determined that at any point Xz along the x-axis (reference 34) and within the bore 32 can be determined by the following relationship:

$$(Az-Ai)/(Ai-Ao)=Xz/Xo$$

From the above equation, it can be determined that the radial cross sectional area of the nozzle at any point Xz along the x-axis 34 can be determined by the equation:

$$Az=Ai-(Xz(Ai-Ao)/Xo)$$

The use of the above formula will assure the desired uniform change in cross-sectional area, increasing velocity with, however, a minimum amount of turbulence and consequential loss of pressure within the bore.

From the above equation the radius Rz for any area Az will be equal to the square root of said area az divided by pi, or $$Rz=(Az/pi)^{\frac{1}{2}}$$

For optimal results, it has been found that the imaginary angle between taper 48 and the x-axis 34 on the one hand, and taper 50 and the x-axis 34 on the other hand, should not exceed 15 degrees.

Employing empirical methods of curve calculation, it has been found that curve 60 of FIG. 5 can be characterized by the linear equation:

$$X+9.35\ Z-2.35=0$$

In a typical embodiment, the bore of a nozzle made in accordance with the above equations will have a cross-sectional input diameter of 0.50 inches and an output diameter of 0.313 inches, and the length of the x-axis between said input and said output will be about 0.875 inches. Accordingly, the z-axis (bore diameter) component may be seen to decrease by one unit for approximately every nine units of increase in the axial, x-axis direction, and the ratio of the input-to-output cross-sectional diameters is about 1.6 to one.

After fluid flow has exited from nozzle bore 32 (passing output 54), the fluid flow will pass into the nozzle head 58 including its above sprinkler head 36 and deflector plate 38.

Figure 6:
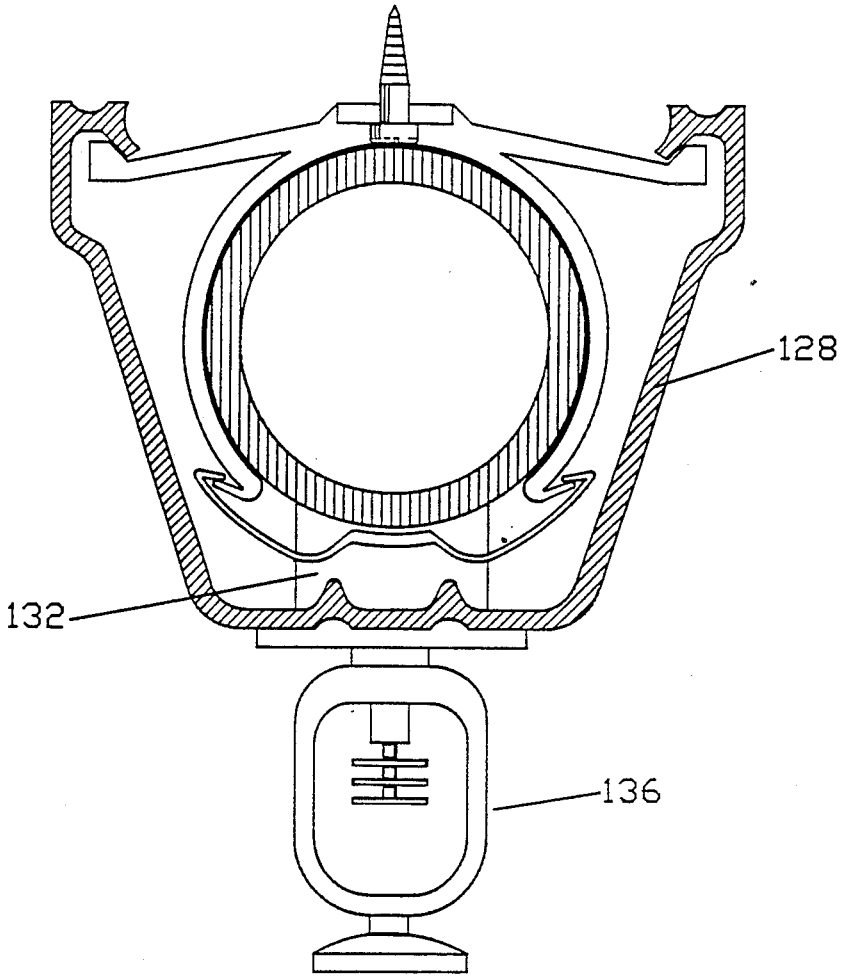
FIG. 6 is a radial cross-sectional view of an alternative embodiment of the sprinkle nozzle system of FIG. 3.

As may be noted in a comparison of the views of FIG. 3 and 6, the bore 32 may lead into either an elbow as is the case in bore 32 of the embodiment of FIG. 3 or may continue directly downward as is shown in the embodiment in FIG. 6. In either embodiment, the desired object of the present invention, namely, an increase in fluid velocity without an increase in fluid pressure is achieved. Thereby, non-turbulent fluid will be discharged through the sprinkler head 36 or 136 and, as above noted, such non-turbulent fluid will enable such sprinkler heads to generate a far larger area of fluid distribution than has heretofore been known.

It is also noted that cover 128 of the embodiment of FIG. 6 provides an anti-vibration function.

It is to be appreciated that a nozzle in accordance with the present invention need not necessarily be employed as a component of a modular pipe system and that it may be equally well employed in non-modular water piping systems. Also, the effect of the inventive nozzle bore may be achieved through the use of an insert having the above defined internal geometry, into the interior of such a prior art sprinkler bore. When such a retrofit of a prior art sprinkler nozzle bore is effected, the sprinkler system will thereby experience an enhanced efficiency by reason of the above described non-turbulent velocity increase of the fluid reaching the nozzle head from bore 32.

It is to be appreciated that the circular cross section of bore 32, above upon which the above computations are based, may be varied somewhat from the circular, such as in the use of oblong or elliptical cross sections, so long as the change in cross sectional area of such structures follows the basic rule of uniform differential area reduction established by the afore set forth formula:

$$Ao/Ai=(Xc-Xo)/Xc$$

and the further equations which derived therefrom.

While there has been shown and described the preferred embodiments of the present invention, it will be understood that the invention may be embodied otherwise than is herein specifically illustrated and described and that, with the in said embodiment, certain changes in the detail and construction, and in the form and arrangement in the parts, may be made without departing from the underlying idea or principles of this invention within the scope of the appended Claims.

Having thus described my invention of what I claim as new, useful and non-obvious and, accordingly, secure by Letters of Patent of the United States is:

1. A constant pressure fluid flow acceleration nozzle system, comprising:

a nozzle having a bore, said bore having a substantially conical inner surface, from an input having an area Ai to an output having an area Ao, said output being an axial length Xo from said input, in which said conical surface of said bore exhibits a slight convexity relative to a longitudinal axis of said bore and in which the radial cross sectional area Az of said bore, at any axial point Xz between said input and said output of said bore is defined by the equation:

$$Az=Ai-(Xz(Ai-Ao)/Xo),$$

and the radius Rz of any axial point Xz is thereby defined by the equation:

$$Rz=(Az/pi)^{\frac{1}{2}}$$

whereby a taper of said substantially conical bore surface in accordance with said equations will effect an increased velocity while maintaining a substantially constant pressure throughout the length of bore, with a resultant low turbulence output of the nozzle system.

2. The nozzle system as recited in claim 1 in which said conical inner surface of said bore defines about one unit of length of decrease in radial dimension for about every nine units of distance of axial length of said bore.

3. The nozzle system as recited in claim 1 in which the ratio of the radius of said input of said bore to the radius of said output thereof is about 1.6 to 1.

4. The nozzle system as recited in claim 2 in which the ratio of the radius of said bore to the radius of said output is about 1.6 to 1.

5. The nozzle system as recited in claim 1, in which a positive line of taper of said bore of said nozzle is substantially defined by the linear equation:

$$X+9.35\ Z-2.35=0$$

in which X equals the central longitudinal axis of said conical section of the bore, and Z equals the axis of the cross section of the diameter of the input to said bore.

6. The nozzle system as recited in claim 2 in which a positive line of taper of said bore of the nozzle is substantially defined by the linear equations:

$$X+9.35\ Z-2.35=0$$

7. The nozzle system as recited in claim 3 in which a positive line of taper of said bore of the nozzle is substantially defined by the linear equation:

$$X+9.35\ Z-2.35=0$$

8. The nozzle system as recited in claim 1, said nozzle system further comprising:

a nozzle head in mechanical and fluid communication with said fluid nozzle, said nozzle head having an input and an output, said input thereof in fluid communication with the output of said bore of said nozzle.

9. The nozzle system as recited in claim 8, in which the fluid flow of the output of a nozzle head is in fluid thrust alignment with the output of said bore of said nozzle system.

10. The nozzle system as recited in claim 8 in which the said fluid thrust output of said nozzle head is at substantially right angles to the fluid thrust of the output of said bore.

11. The system as recited in claim 10, further comprising:

a nozzle system housing comprising means for defining fluid flow integral with said input of said bore and at right angle to said axis of said bore, whereby said housing means may be snapped-fittably inserted into a modular waterpipe system.

12. The system as recited in claim 11, further comprising:

a nozzle system housing comprising means for defining a fluid flow integral with said input of said bore and at right angle of the axis of said bore, whereby said housing means may snapped-fittably inserted into a modular waterpipe system.

13. The system as recited in claim 1 in which any orthonormal cross section of said conical inner surface of said bore comprises an ellipse.

* * * * *